US005273217A

United States Patent [19]

Bartels et al.

[11] Patent Number: 5,273,217

[45] Date of Patent: Dec. 28, 1993

[54] METHOD AND APPARATUS FOR IMPROVING THE CRUSHING ACTION OF DEMOLITION TOOLS

[75] Inventors: Robert-Jan Bartels; Helmar Näfe; Jürgen Winkler, all of Essen, Fed. Rep. of Germany

[73] Assignee: Krupp Maschinentechnik Gesellschaft mit beschränkter Haftung, Essen, Fed. Rep. of Germany

[21] Appl. No.: 793,118

[22] Filed: Nov. 18, 1991

[30] Foreign Application Priority Data

Nov. 17, 1990 [DE] Fed. Rep. of Germany ..... 4036705

[51] Int. Cl.[5] ..... B02C 1/02

[52] U.S. Cl. ..... 241/30; 241/266; 241/291

[58] Field of Search ..... 241/30, 264, 266, 291; 30/134

[56] References Cited

U.S. PATENT DOCUMENTS

| | | | |
|---|---|---|---|
| 3,386,667 | 6/1968 | May | 241/264 |
| 3,980,341 | 9/1976 | Musannif et al. | 299/36 |
| 4,132,017 | 1/1979 | Robson et al. | 37/141 R |
| 4,406,412 | 9/1983 | Alexandersson | 241/36 |
| 4,512,524 | 4/1985 | Shigemizu | 241/101.7 |
| 4,669,187 | 6/1987 | Pardoe | 30/134 |
| 5,062,227 | 11/1991 | DeGier et al. | 37/117.5 |
| 5,199,658 | 4/1993 | Bartels et al. | 241/266 |

FOREIGN PATENT DOCUMENTS

| | | | |
|---|---|---|---|
| 0218899 | 4/1987 | European Pat. Off. . | |
| 0404229 | 12/1990 | European Pat. Off. . | |
| 7227425 | 2/1973 | Fed. Rep. of Germany . | |
| 3112396 | 10/1982 | Fed. Rep. of Germany . | |
| 3802001 | 7/1988 | Fed. Rep. of Germany . | |
| 3342305 | 4/1989 | Fed. Rep. of Germany . | |
| 8904094 | 4/1989 | Fed. Rep. of Germany . | |
| 2609296 | 7/1988 | France . | |
| 1100013 | 6/1984 | U.S.S.R. | 241/264 |
| 8803213 | 5/1988 | World Int. Prop. O. | 241/266 |

*Primary Examiner*—Mark Rosenbaum
*Assistant Examiner*—John M. Husar
*Attorney, Agent, or Firm*—Spencer, Frank & Schneider

[57] ABSTRACT

A method of crushing material between cooperating jaws of a crushing jaw assembly of a demolition tool includes the steps of applying a closing force to at least one of the jaws for urging the jaws toward one another; and imparting a vibratory motion to at least one of the jaws while the closing force is applied.

12 Claims, 2 Drawing Sheets

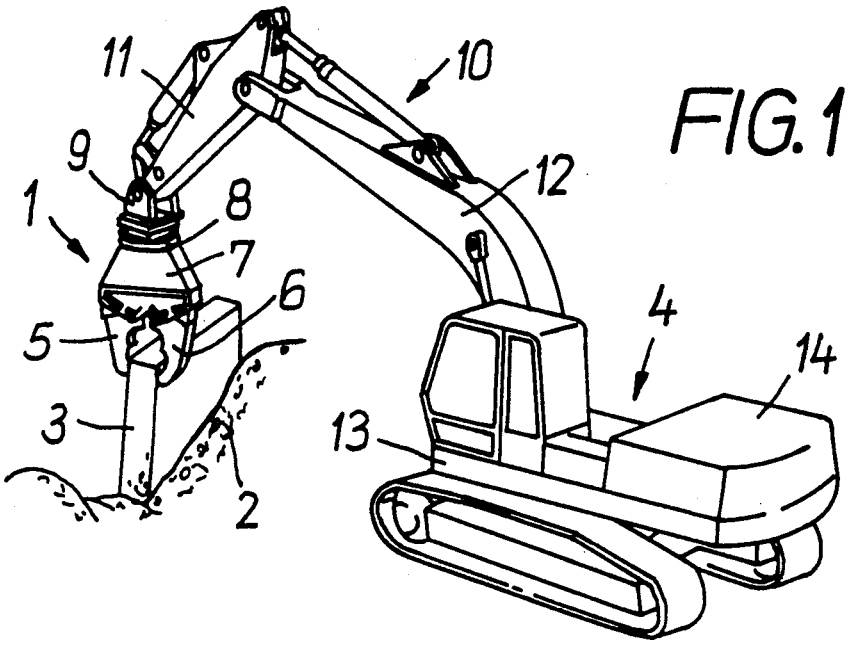
FIG. 1
FIG. 2
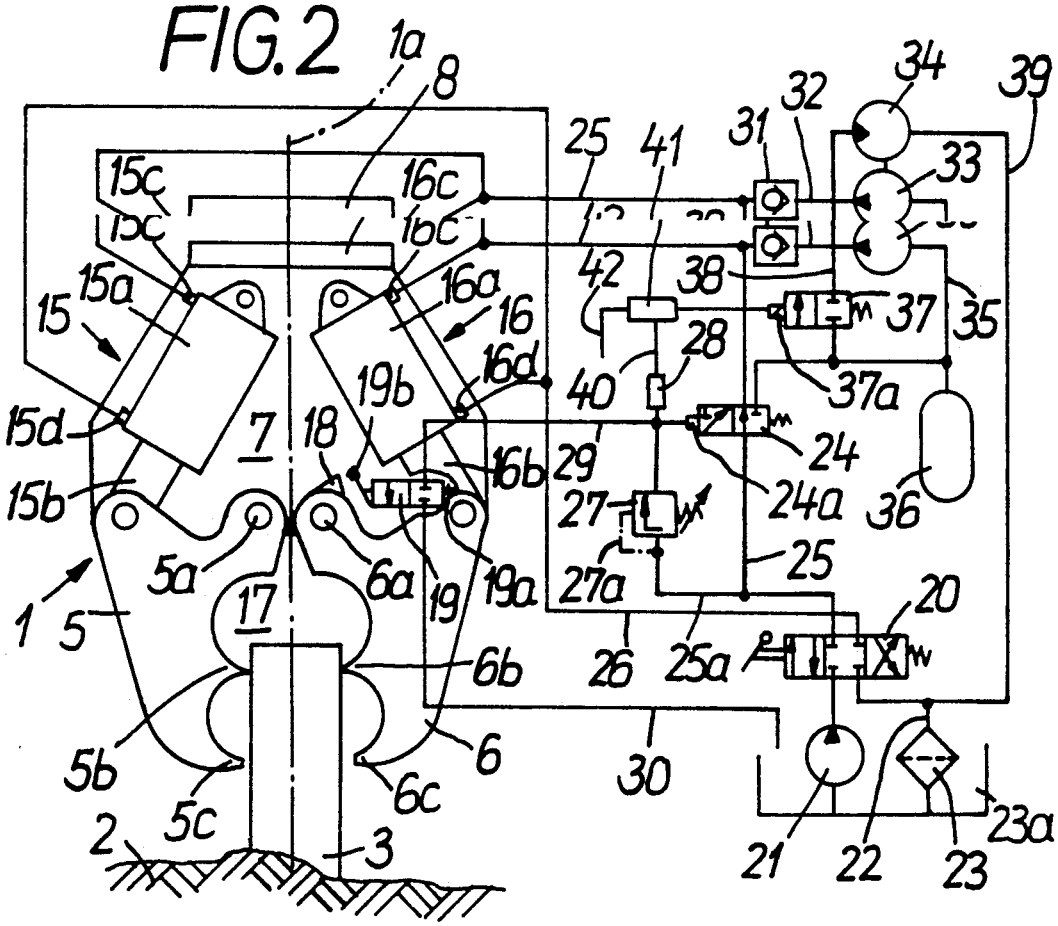

METHOD AND APPARATUS FOR IMPROVING THE CRUSHING ACTION OF DEMOLITION TOOLS

CROSS REFERENCE TO RELATED APPLICATION

This application claims the priority of German Application No. P 40 36 705.3 filed Nov. 17, 1990, which is incorporated herein by reference

BACKGROUND OF THE INVENTION

The present invention relates to a method and an apparatus for improving the crushing action of demolition tools, which include a carrier body on which two cooperating jaws, shears or tongs (hereafter collectively also referred to as "jaws") are mounted for engaging, from opposite sides, the matter to be crushed. At least one of the jaws is driven and is thus movable relative to the carrier body.

The drive unit which operates the demolition jaw or jaws and which also generates the necessary closing force during the crushing process may have any desired construction. In present-day demolition tools the drive unit is usually composed of one or more cylinder units with which one jaw is operated or both jaws are driven simultaneously.

German Patent 3,342,305 to which corresponds U.S. Pat. No. 4,512,524 discloses a concrete crusher which includes two jaws that are movably supported by a carrier body and which are each driven by means of a hydraulic cylinder unit.

In contrast thereto, the demolition shears disclosed in European Patent Application 218,899 includes only one movable shearing arm and a drive unit composed of one cylinder unit; the second shearing arm is immovably fastened to the carrier body.

Demolition tools of the type under discussion (demolition jaws or demolition shears) represent in many cases, particularly in the demolition and reconstruction of buildings, an effective alternative to a hydraulic/-pneumatic percussion mechanism, a steel ball or explosives. The discussed demolition tools are advantageous in that they operate with low noise and are capable of crushing metal reinforcements and separating—for the purpose of reprocessing/recycling—the different construction materials that are encountered during the crushing process.

The demolition tools according to the prior art are similar insofar as they each generate a continuously active closing force. In crushing concrete or the like, with or without metal reinforcements, in certain work situations the breaking and cutting force exerted by the demolition tool does not produce the desired result. Consequently, frequent changes of position, readjustments and restarting of the demolition tool are required which may lead to a reduction of efficiency and output.

SUMMARY OF THE INVENTION

It is an object of the present invention to provide an improved method of enhancing the crushing action of demolition tools and also, to provide an improved demolition tool suitable for implementing the method for producing a better crushing effect and an improved economy of operation as compared to prior art constructions.

This object and others to become apparent as the specification progresses, are accomplished by the invention, according to which, briefly stated, the method of crushing material between cooperating jaws of a crushing jaw assembly of a demolition tool includes the steps of applying a closing force to at least on of the jaws for urging the jaws toward one another; and imparting a vibratory motion to at least one of the jaws while the closing force is applied.

It is thus a basic concept of the invention to at least temporarily superpose vibratory movements on the closing force exerted by the jaws. The pulsating stresses imparted on the material to be crushed in the jaw opening (jaw mouth) may increase the crushing and demolition performance to a considerable degree.

According to an advantageous feature of the invention, during the crushing process at least one of the jaws is directly caused to vibrate; in the simplest case, this may be brought about by means of a vibration generator which directly imparts corresponding movements to the respective jaw or jaws. According to a further feature of the invention, at least one of the jaws is caused to vibrate indirectly, for example, by way of a device attached thereto.

For purposes of improved economy and noise reduction, the vibratory movements are initiated only after the closing force acting on the jaws has risen to a predetermined, adjustable minimum value. Only after the expected crushing effect can no longer be realized during normal operation, is the demolition process continued with superposed vibrations. If this results in the desired work progress, the closing force temporarily drops to below the set minimum value so that the vibratory movements are interrupted. This procedure may be repeated several times during one work cycle, that is, until the jaw opening of the demolition tool is closed.

To prevent the superposition of vibrations from being maintained over an unnecessarily long period of time without achieving any work progress, the vibratory movements are, according to a further feature of the invention, interrupted after each predetermined, adjustable time period.

In order to exclude undesirable stresses on the demolition tool when the jaws are in contact with one another, the method provides that the generation of vibratory movements is discontinued as soon as the jaws approach a predetermined end position in the course of their closing movement.

The tool according to the invention includes a vibration generator which may be energized during operation of the drive unit and which affects at least one movable jaw so as to initiate vibratory movements that act on the material to be crushed.

According to a preferred embodiment, at least one of the two jaws can be connected to be driven by the vibration generator. As a result, one jaw or both jaws directly perform corresponding movements with respect to the carrier body under the influence of the vibration generator.

Preferably, the vibration generator acts on the drive unit of the demolition tool so that the drive unit itself generates the vibratory movements for the respective jaw.

According to another preferred embodiment, the vibratory movements are initiated by means of at least one striking mechanism that is mounted in the jaw or jaws. The striking mechanism impacts directly the material to be crushed in the jaw opening and thus also indirectly causes the jaws to vibrate.

In the simplest case, the percussion mechanisms are composed of a cylinder unit including a striking piston displaceable by a pressure medium against a resetting force. The striking mechanisms may include a reversal control for the movement of the striking piston, similarly to hydraulic hammers.

According to a further embodiment of the invention, the vibratory movements may be effected by a pressure medium exposed to a pulse generator. The pulse generator may be a conventional rotary valve pulse generator which supplies a pulsating stream of pressure medium. The stream may be employed to charge the drive unit (composed of one or several cylinder units) and/or at least one striking mechanism.

According to still another embodiment of the invention, the vibratory movements are effected by means of at least one unbalance generator which is in engagement with a jaw. Particularly in embodiments that have two movable jaws, the latter are each equipped with an unbalance generator, preferably in such a way that the forces exerted by the unbalance generators are directed opposite to one another with respect to the material to be crushed.

The demolition tool may be so structured according to the invention that the material to be crushed is subjected to vibratory action that is generated by the drive unit as well as by at least one striking mechanism or an unbalance generator. Preferably, the vibratory movements are initiated by actuation of a switching unit only after a characteristic value—which constitutes a measure for the stress during the demolition process—has risen to a predetermined, adjustable minimum value. If the demolition tool is operated hydraulically, the operating pressure for the drive unit is particularly applicable as a characteristic value. The longest possible time period for the vibratory movements can be adjusted by means of a timing member which energizes the vibration generator as soon as the characteristic value reaches the minimum value.

In a preferred embodiment of the invention, an energizing valve is provided which is controlled by the operating pressure of the drive unit. A timing member connected to the valve output effects an eventual energization of the pulse generator. The energy supply for the pulse generator can also be interrupted by the timing member independently of the position of the energizing valve. If thus the operating pressure, after it has reached a predetermined minimum value, does not drop below this minimum value, the pulse generator is nevertheless de-energized after the expiration of a predetermined time period.

For safety reasons, at least one driven jaw has an associated limit switch by means of which the vibration generator is de-energized when, in the course of the closing movement, the jaw approaches a predetermined end position. This arrangement prevents the vibratory movements from being maintained or started when the characteristic value reaches the predetermined minimum value at a time when, upon the completion of the closing movement, the jaws are in engagement with one another.

BRIEF DESCRIPTION OF THE DRAWING

FIG. 1 a schematic perspective view of a hydraulic excavator having a crushing jaw assembly that incorporates the invention.

FIG. 2 is a side elevational view of crushing jaws of the FIG. 1 and a circuit diagram of a preferred embodiment of the invention.

DESCRIPTION OF THE PREFERRED EMBODIMENTS

Figure 3:
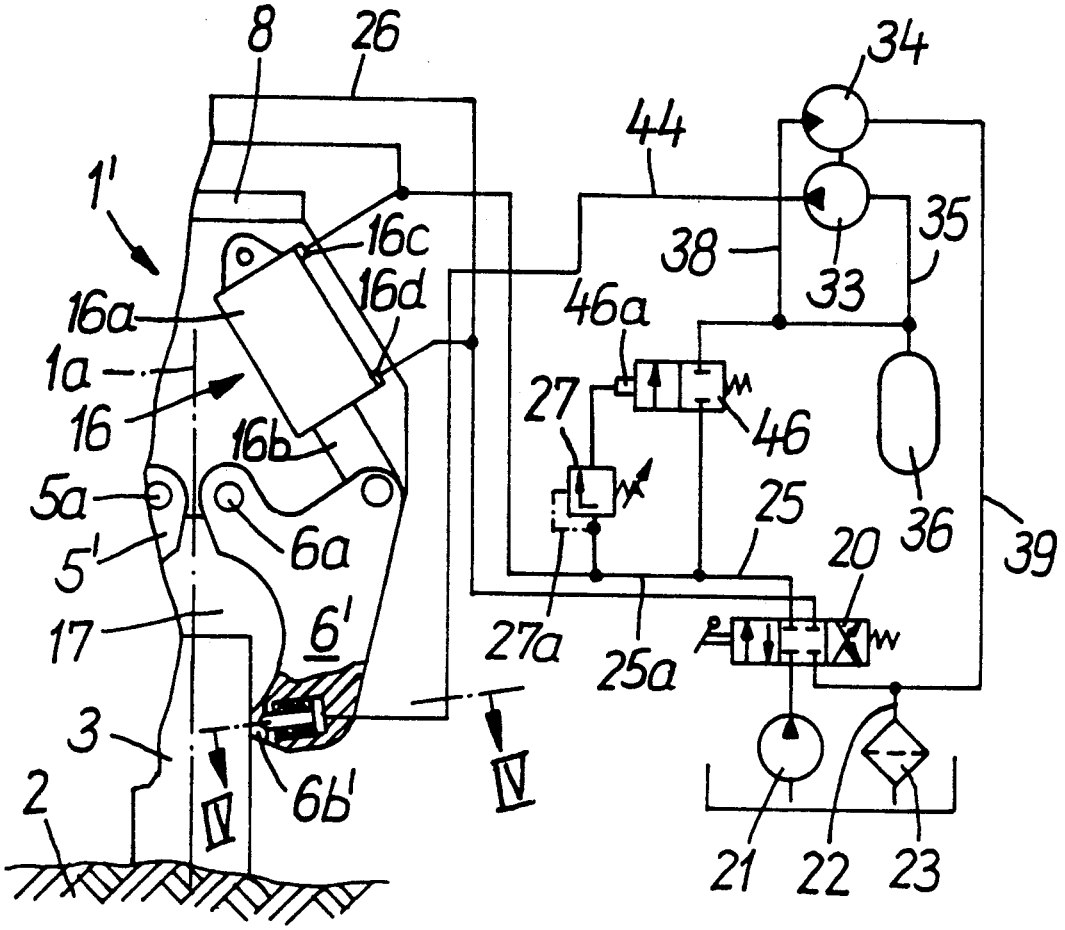
FIG. 3 is a fragmentary side elevational view of crushing jaws, shown partially in section, and a circuit diagram of another preferred embodiment of the invention.

FIG. 1 shows a crushing jaw assembly 1 in a hydraulic excavator 4 for the crushing/demolition of a concrete slab 3 firmly held in the ground 2.

In a known manner, the crushing jaw assembly includes two driven jaws 5 and 6 movably held in a carrier body 7. The carrier body 7 is rotatably fastened by a coupling plate 8 to a connecting bracket 9 which, in turn, is pivotally mounted on an excavator arm 10, essentially composed of a front pivot arm 11 and a rear carrier arm 12. The latter is pivotal with respect to a platform 13 of the hydraulic excavator which accommodates, among others, a hydraulic unit 14 serving as the energy source for operating the crushing jaw assembly 1.

Turning to FIG. 2, the drive unit for operating the two jaws 5 and 6 includes two cylinder units 15 and 16 which are articulated by way of their cylinder housings **15*a*, 16*a* and their piston rods 15*b*, 16*b* to the carrier body 7 and the respective jaw 5 and 6. The jaws 5 and 6 are supported at the carrier body 7 by respective rotary bearings 5*a* and 6*a*, at a distance from the articulation of piston rods 15*b*, 16*b* and define an adjustable jaw opening 17 of the demolition tool into which the concrete slab 3** to be crushed projects during the demolition process.

Each jaw 5 and 6 has two teeth **5*b*, 5*c* and 6*b*, 6*c* which extend along the assembly axis 1*a* and project theretoward. The jaws 5 and 6, together with the respective teeth 5*b*, 5*c* and 6*b*, 6*c*, apply a pressing force on the slab 3 by virtue of a closing force exerted by cylinder units 15, 16. The arrangement and configuration of the major components of the crushing jaw assembly 1 are essentially symmetrical with respect to the longitudinal axis 1*a***.

In the vicinity of the rotary bearing **6*a*, the jaw 6 carries an abutment lug 18 which is arranged in such a manner with respect to a limit switch 19 (formed as a two-position, "on-off" valve) fastened to carrier body 7 that, by contacting a switch sensor 19*b*, it depresses the limit switch 19 against the force of a reset spring 19*a* from the "off" (closed) position into the "on" (open) position as soon as the two jaws 5 and 6 approach in the course of the closing movement, a predetermined end position in which the jaws 5, 6** are close to a mutually contacting position.

The start-up, reversal or de-energization of the crushing jaw assembly 1 is effected by a 3-position, 2-way valve 20 which has an input connected with a hydraulic source 21 and an output connected to a pressureless return conduit 22 including a return filter 23. The outlet side of the valve 20 is connected, through the intermediary of a pressure controlled direction control valve 24 and a conduit 25, with the piston rod-extension inlets 15c, 16c of the two cylinder units 15, 16 and via a conduit 26 with piston rod-retraction inlets 15d, 16d.

As long as direction control valve 24 is in the position shown in FIG. 2, a displacement of the valve 20 to the right causes the inlets 15c, 16c to be charged with pressure through conduit 25 and the inlets 15d, 16d to be pressure-relieved through conduit 26. As a result, a closing force is exerted by way of piston rods 15b, 16b on crushing jaws 5, 6 which thus move toward one another against the resisting force of the concrete slab 3. A displacement of the valve 20 to the left causes the inlets 15d, 16d to be charged with pressure through conduit 26 and thus the jaws 5, 6 are moved away from one another so as to perform an opening movement which enlarges jaw opening 17.

Conduit 25 has a branch conduit 25a which includes a vibration actuator valve 27 whose position can be affected—against an adjustable biasing force—by a control conduit 27a that opens into conduit branch 25a. In the flow-through position (not shown) of the vibration actuator valve 27, the operating pressure present in conduits 25, 25a is applied to the control inlet 24a of direction control valve 24, a pressure-controlled timing member 28 and a conduit 29 which may be connected by the valve 19 to a relief (return) conduit 30. As long as the valve 19 is in the illustrated blocking ("off") position, no communication exists between return conduit 30 and conduit 29. Thus, the latter—similarly to timing member 28 and control inlet 24a—may be charged with the operating pressure. The vibration actuator valve 27 is set in such a way that it switches from the blocking position to the flow-through position only after the operating pressure in conduits 25, 25a has reached a set minimum value which, in turn, is a measure for the closing force exerted by cylinder units 15, 16 on jaws 5, 6.

The conduit 25 is connected to a pulsating fluid conduit 32 with the intermediary of a check valve 31. The conduit 32 is chargeable with a pulsating pressure by a rotary-valve pulse generator 33 which is driven by a hydraulic motor 34. The pulse generator 33 is connected with a second outlet of the valve 24 by way of an intake conduit 35 also communicating with a pressure reservoir 36. Through the intermediary of a pressure controlled shutoff valve 37, the intake conduit 35 communicates with a driving conduit 38 for a hydraulic motor 34, whose return conduit 39 is, in turn, connected to the relief conduit (return conduit) 22.

A pressure switch 28 actuates, through a switching conduit 40, a timer 41 which is connected with the control inlet 37a of the shutoff valve 37 and with an outlet 42.

As soon as timer 41 is pressurized by means of the switch 28, the communication between conduits 40 and 42 is interrupted and simultaneously a counting process is started, whose duration is adjustable. As long as the counting is in progress, the shutoff valve 37 which is pressurized at the inlet 37a, is in its non-illustrated open (flow-through) position so that if the valve 24 is in an appropriate position, the hydraulic motor 34 is supplied with driving energy through the conduit 38. Upon completion of the counting process, the timer 41 opens the relief outlet 42, whereby the pressure drops at the inlet 37a and thus the shutoff valve 37 switches to the illustrated closed (blocking) position. Since the energy supply to the hydraulic motor 34 is interrupted, the pulse generator 33 that has been active during the time period in question is turned off. The displacement of the vibration actuator valve 27 into the non-illustrated flow-through position causes the valve 24 to switch into its second position (not shown) in which communication is established between conduits 25 and 38, among others, through the shutoff valve 37. Pressure reservoir 36 serves to compensate the pressure fluctuations which were intentionally generated during operation of the pulse generator 33 and which, as fed-back pressure fluctuations, are undesirable outside of the region of cylinder units 15, 16.

Thus, the pressure switch 28 and timer 41 constitute a timing member which, at the end of an adjustable, predetermined time period, automatically interrupts and prevents the generation of further pulsating pressure fluctuations independently of the position of the vibration actuator valve 27.

In the description which follows, the operation of the embodiment of FIG. 2 will be set forth.

After start-up of the crushing jaw assembly 1 by displacement of the valve 20 to the right (that is, communication is established between conduit 25 and pump 21 and between conduit 26 and sump 23a), inlets 15c, 16c are charged with pressure to initiate the normal closing process which results in a closing force exerted by jaws 5, 6 that serve to crush/demolish the concrete slab 3. If the action of the jaws does not result in the desired work progress, the operating pressure in conduits 25, 25a and 27a increases so that the vibration actuator valve 27, which was initially in the shutoff (blocking) position, eventually switches into the vibration-actuating position and thus moves the valve 24 into its non-illustrated second operating position (that is, to the right) and, under the influence of switches 28 and 41, moves the shutoff valve 37 into the flow-through (open) position. These operative steps cause the hydraulic motor 34, which is supplied with energy through conduits 25, 38, to drive the pulse generator 33 so as to generate intentional pressure fluctuations in conduits 32, 25 and in cylinder units 15, 16, as a result of which jaws 5, 6 are directly caused to vibrate. The activation of hydraulic motor 34 and pulse generator 33 thus leads to vibratory movements being temporarily superposed on the closing force to improve the demolition effect of the jaws.

The superposition of vibrations lasts as long as the vibration actuator valve 27 is, as a function of the operating pressure in conduits 25, 25a and 27a, in the actuating position. In any event, the duration of such actuating position is limited in time by the time period predetermined by timer 41. At the end of the time period the outlet 42 is opened and thus, by returning the shutoff valve 37 into the illustrated blocking position, the generator 33 is deenergized.

If the generation of vibratory movements within a predetermined period of time does not result in work progress, the operator is able to open the jaws 5, 6 of the crushing jaw assembly 1 by switching the valve 20 and, for example, moving the assembly 1 to another position.

Undesirable stress on the components of the crushing jaw assembly 1 is prevented by moving the limit switch 19, toward the end of the closing movement, into the open position (not shown) by means of the abutment lug 18, thus connecting the conduit 29 to the pressureless return conduit 30. It is thus impossible to charge the valve 24 and the pressure switch 28 with the pressure required to initiate the vibratory movements even if the vibration actuator valve 27, due to a rise in the operating pressure, assumes its actuating position.

It is an advantage of the embodiment of FIG. 2 that the jaws 5, 6 are temporarily directly caused to vibrate themselves under the influence of cylinder units 15, 16 and considerable additional pulsating forces are generated which support the demolition process. This, however, requires that the vibration generator (hydraulic motor 34 and rotary valve pulse generator 33) be designed accordingly.

Figure 4:
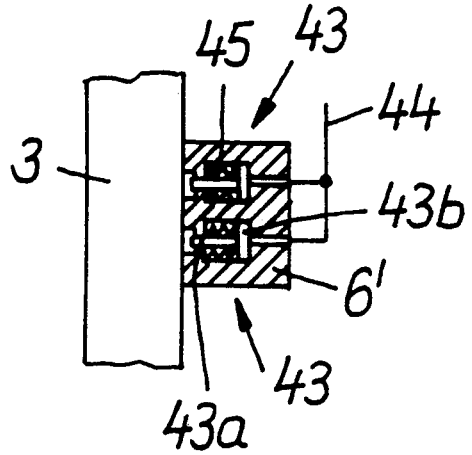
FIG. 4 is a sectional view along line IV—IV of FIG. 3.

Turning now to FIGS. 3 and 4, the demolition jaw assembly 1' structurally differs from the jaw assembly 1 in that the clamping jaws 5' and 6' each have but a single tooth (such as 6b') which projects toward the longitudinal axis 1a. Each clamping jaw is provided with two striking mechanisms 43 in the region of its tooth. The striking mechanisms—when seen transversely to the plane of FIG. 3—lie spaced from one another in the region of the tooth, as shown in FIG. 4. Each striking mechanism includes a piston rod 43a and a piston 43b that can be extended relative to the jaw in which it is mounted and can be displaced outwardly against the force of a resetting spring 45 by pressure pulsations supplied by a pulse conduit 44, that is in the direction toward the concrete slab 3 to be crushed.

In contrast to the embodiment according to FIG. 2, the rod-extension inlets of the cylinder units—for example the rod-extension inlet 16c of cylinder unit 16—are connected by a conduit branch 25a and a conduit 25 with the valve 20 described in connection with the FIG. 2 embodiment. As concerns the cylinder units, the valve 20 thus has only the function of causing the cylinder units to perform a closing or opening movement.

The vibration actuator valve 27 also connected with conduit branch 25a affects, through control input 46a, the position of a spring-biased shutoff valve 46 which, in its open position, connects conduit 25 with the conduit 38 for hydraulic motor 34, with the intake conduit 35 for the rotary valve pulse generator 33 and with the pressure reservoir 36.

The striking mechanism 4 is oscillated by the pulse generator 33 through the pressure conduit 44.

In the description which follows, the operation of the FIG. 3 embodiment will be set forth.

Actuation of the valve 20 by displacement to the right (as viewed in FIG. 3) causes the cylinder units to be charged with pressure through conduits 25, 25a so that their respective piston is driven outwardly. As a result, the teeth of the jaws 5', 6' contact the concrete slab 3 to be crushed and exert thereon the closing force generated by the cylinder units. The striking mechanisms 43 are not in operation at this time, since the shutoff valve 46 is in the blocking position shown in FIG. 3. Consequently, the rotary valve pulse generator 33 is not active and the pulse conduit 44 is not charged with pressure. As urged by the reset springs 45, the piston rods 43 and the pistons 43b are in their rest position shown in FIG. 4.

If the normal pressurizing of the cylinder units does not achieve the desired crushing results, the operating pressure in conduits 25, 25a and 27a increases. As soon as a minimum pressure value determined by the vibration actuator valve 27 is reached, the latter switches into the non-illustrated actuating position and moves, by applying pressure to control inlet 46a, the shutoff valve 46 into the open position (not shown) to thus energize the hydraulic motor 34 which, in turn, drives the pulse generator 33. The latter applies a fluctuating fluid pressure to the striking mechanisms 43 by way of pulse conduit 44 in such a way that their components 43a and 43b perform back and forth movements. As long as the valve 27 is in the actuating position, vibratory movements that act on concrete slab 3 are thus additionally superposed on the closing force exerted by the jaws 5' and 6'. Since the latter absorb the pulsating forces emanating from the striking mechanisms 43, they are likewise caused to vibrate indirectly by way of these pulsating forces. The operative inclusion of the pulse generator 33 as determined by the operating conditions achieves results which would otherwise not be possible without changing the position of the demolition jaws.

The FIG. 3 embodiment, similarly to the embodiment according to FIG. 2, can be advantageously modified in that the vibration actuator valve 27 is connected with the shutoff valve 46 through the intermediary of pressure switch 28, switching conduit 40, timer 41 and outlet 42. In such a modification, shutoff valve 46 is switched automatically into the illustrated closed position at the end of an adjustable, predetermined period of time, independently of the position of the valve 27, thus interrupting the energy supply to hydraulic motor 34.

Figure 5:
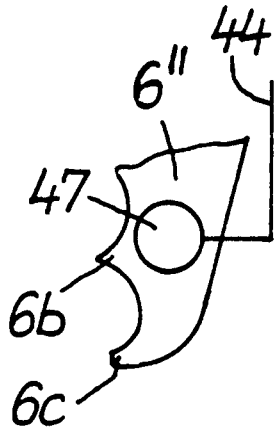
FIG. 5 partial view of a crushing jaw to which an unbalance is attached in accordance with a further preferred embodiment of the invention.

In the embodiment according to FIG. 5, the vibratory movements of the crushing jaws (of which only jaw 6'' is shown) are imparted by unbalance generators 47 attached to the respective jaws. These unbalance generators are arranged and configured in such a manner that the forces they exert are always directed opposite to one another with respect to the concrete slab 3 to be crushed.

It is within the scope of the invention to so design a crushing jaw assembly and its power supply that the several types of vibration explained in connection with FIGS. 2-5 may be simultaneously, or separately or sequentially superposed on the closing force. If thus, for example, the vibratory movements of the jaws do not yet produce the desired work progress, such may possibly by realized by operatively including the striking mechanisms and/or the unbalance generators.

The method proposed by the present invention can also be performed manually. Preferably, for such an operation a characteristic value is determined which constitutes a measure for the stress on the crushing jaws during the demolition process and this value is displayed. An operator can then initiate the superposition of vibrations on the basis of the predetermined value and, if it does not result in the desired work progress, the operator may switch off the vibratory forces after a period of time that appears suitable.

It will be understood that the above description of the present invention is susceptible to various modifications, changes and adaptations, and the same are intended to be comprehended within the meaning and range of equivalents of the appended claims.

What is claimed is:

1. A method of crushing material between cooperating jaws of a crushing jaw assembly of a demolition tool, comprising the following steps:

(a) applying a closing force to at least one of the jaws for urging the jaws toward one another in a single, non-oscillating closing stroke;

(b) imparting a vibratory motion to at least one of said jaws while performing step (a) only if the closing force has reached a predetermined minimum magnitude;

(c) arbitrarily setting said predetermined minimum magnitude; and (d) automatically discontinuing step (b) after a settable period running from the beginning of step (b).

2. A method as defined in claim 1, wherein step (b) comprises the step of superposing pulsations on the closing force as the closing force is applied according to step (a).

3. A method as defined in claim 1, wherein step (b) comprises the step of imparting a vibratory motion to said one jaw separately from the step of applying the closing force.

4. A method as defined in claim 1, further comprising the step of preventing performance of step (b) when the jaws, during a closing motion caused by the closing force, reach a predetermined terminal position relative to one another.

5. A demolition tool comprising (a) a carrier body;

(b) a first jaw mounted on said carrier body for movement relative thereto;

(c) a second jaw mounted on said carrier body and cooperating with said first jaw to define therewith a jaw opening to be occupied by an item to be crushed;

(d) a closing force-exerting means comprising a driving unit having a force output connected to said first jaw for applying a closing force to said first jaw to cause movement of said first jaw towards said second jaw in a single, non-oscillating closing stroke;

(e) vibration-generating means comprising pulse-generating means connected to said driving unit for generating a pulsating closing force at said force output of said driving unit for imparting vibrations to said first jaw during application of the closing force;

(f) a control circuit operatively connected to said first jaw and said pulse generator; said control circuit including (1) a vibration actuator valve having an actuating position for operatively coupling said pulse generator to said first jaw and an inactive position for operatively uncoupling said pulse generator from said first jaw;

(2) closing force-responsive means for placing said vibration actuator valve into said actuating position only if said closing force has reached a predetermined magnitude;

(3) means for arbitrarily setting said predetermined magnitude at said closing force-responsive means; and (4) timing means for placing said vibration actuator valve into said inactive position after an arbitrarily settable, predetermined period running from the time said vibration actuator valve is placed into said actuating position.

6. A demolition tool as defined in claim 5, further comprising actuator means for operatively coupling said vibration-generating means to and for disconnecting said vibration-generating means from said first jaw.

7. A demolition tool as defined in claim 5, wherein said vibration-generating means further comprises a striking mechanism mounted in said first jaw and having an impact member; and means connected to said striking mechanism for causing an oscillating motion of said impact member.

8. A demolition tool as defined in claim 5, wherein said pulse-generating means comprises a fluid pressure medium, a pulse generator and a conduit containing said fluid pressure medium, said conduit communicating with said pulse generator for exposing said fluid pressure medium to said pulse generator.

9. A demolition tool as defined in claim 5, wherein said vibration-generating means further comprises an unbalance generator mounted on said first jaw.

10. A demolition tool as defined in claim 5, further wherein said circuit comprises a limit switch means operatively connected to said first jaw and said pulse generator for operatively disconnecting said pulse generator from said first jaw when said first jaw reaches a predetermined end position during movement thereof towards said second jaw.

11. A demolition tool as defined in claim 5, further comprising an energy source for supplying the pulse generator with energy; and switching means for selectively connecting said energy source to or disconnecting said energy source from said pulse generator; said switching means being connected to said timing means and being controlled by said timing means independently from the positions of said vibration actuator valve.

12. A demolition tool as defined in claim 5, wherein said driving unit comprises (a) a force generator;

(b) conduit means for coupling said force generator to said first jaw; and (c) a valve situated in said conduit means and being arbitrarily movable into a position in which communication is established between said force generator and said first jaw for applying the closing force to said first jaw to cause a single closing movement of said first jaw towards said second jaw.

* * * * *